United States Patent [19]

Smith

[11] Patent Number: 4,740,786

[45] Date of Patent: Apr. 26, 1988

[54] APPARATUS FOR DRIVING LIQUID CRYSTAL DISPLAY

[75] Inventor: Robert S. Smith, Cupertino, Calif.

[73] Assignee: Apple Computer, Inc., Cupertino, Calif.

[21] Appl. No.: 50,933

[22] Filed: May 15, 1987

Related U.S. Application Data

[63] Continuation of Ser. No. 693,475, Jan. 18, 1985, abandoned.

[51] Int. Cl.[4] ..... G09G 3/36

[52] U.S. Cl. ..... 340/784; 340/752; 340/811; 350/332

[58] Field of Search ..... 340/784, 782, 765, 802, 340/811, 752; 350/332, 333

[56] References Cited

U.S. PATENT DOCUMENTS 3,787,834 1/1974 Elliot ..... 350/332
4,317,115 2/1982 Kawakami ..... 340/805

FOREIGN PATENT DOCUMENTS 0175499 3/1986 European Pat. Off. .
2124816 2/1984 United Kingdom .
2139795 11/1984 United Kingdom .

*Primary Examiner*—Gerald L. Brigance
*Attorney, Agent, or Firm*—Blakely, Sokoloff, Taylor & Zafman

[57] ABSTRACT

A circuit for accepting serial data from a source meant for video display and displaying it on a liquid crystal display. The data is converted to parallel and is stored in address locations corresponding to four quadrants of a display screen. An input counter controls the writing of data to the memory, while an independent output counter controls the reading of data from the memory and its display on the liquid crystal screen display.

15 Claims, 11 Drawing Sheets

LS163
LS161
RESET
CC1K
CPI
CPI-1
CPI+1
GRD
SS

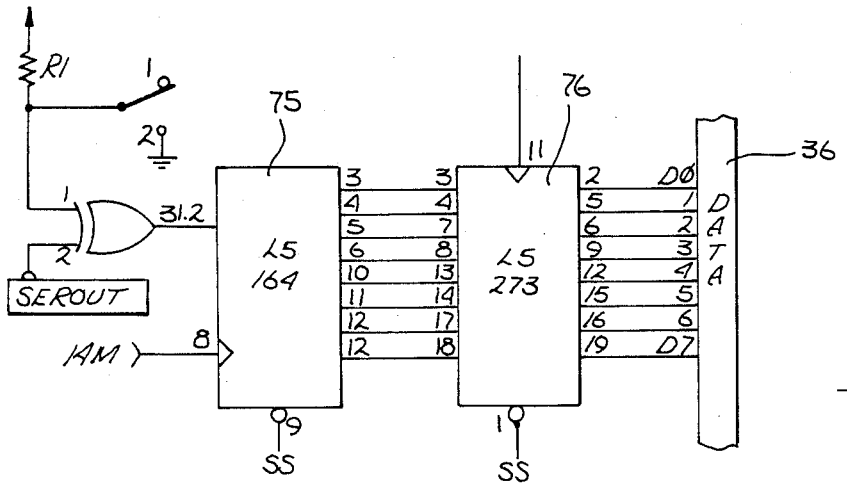
Fig. 7
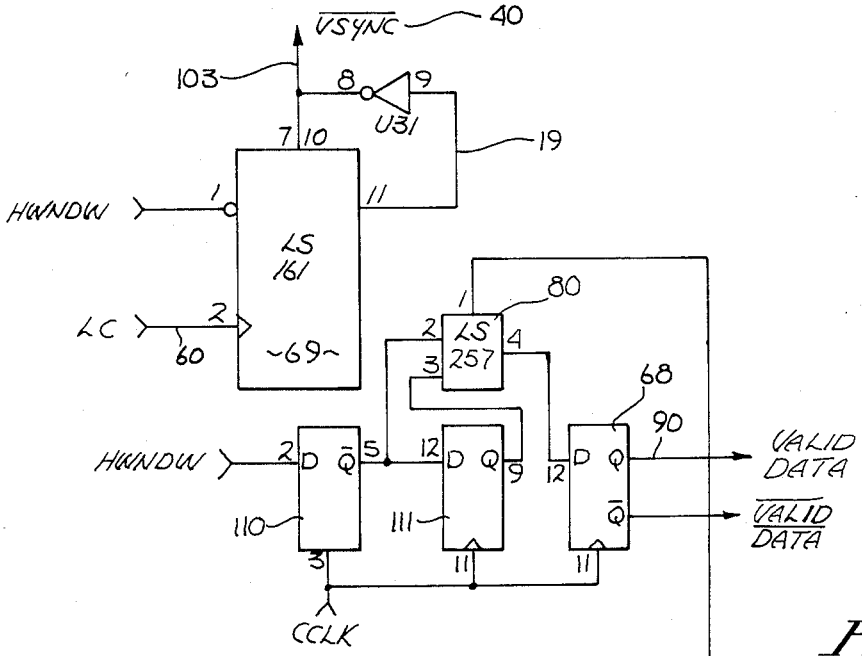
Fig. 8
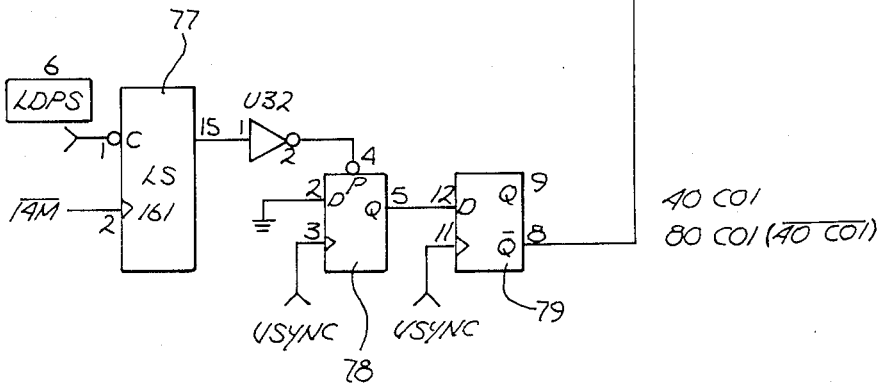

APPARATUS FOR DRIVING LIQUID CRYSTAL DISPLAY

This is a continuation of application Ser. No. 693,475; filed Jan. 18, 1985, now abandoned.

BACKGROUND OF THE INVENTION

1. Field of the Invention

This invention relates to circuits for receiving data from a data source such as a computer and presenting it to a display means.

2. Prior Art

Information generated by a computer is typically displayed on a cathode ray tube (CRT). Signals from the computer are used to deflect an electron beam which writes the information on a CRT screen. CRT screens are raster scanned to make the image. Raster scanning techniques involve forming a series of parallel horizontal beams drawn left to right, from the top of the screen to the bottom.

As miniaturization has increased, computers have become portable, and can now be made to operate on batteries. However, two disadvantages of CRT displays have limited the portability of computers. First, the size required by CRT displays makes them too bulky for some applications, such as lap use. Second, the power requirements of CRTs are such that they cannot be operated by batteries small enough to allow true portability.

One solution to these problems is the use if Liquid Crystal Displays (LDCs). LCDs can be made flat and light weight and have lower power requirements than CRTs, making them ideal portable displays.

The problem with utilizing LCDs as computer displays is the fact that the video output of a computer intended for a CRT display is not compatible with LCD displays. The response time for LCDs is slower than CRTs and the refresh rate (the rate at which displayed data must be updated) is different than that of CRTs.

The present invention proposes a solution to the above problem by the use of a circuit which allows a LCD to utilize output from a computer meant for a CRT display.

SUMMARY OF THE INVENTION

The present invention is a circuit which divides the video signal from a computer into four parts which then each drive one quadrant of a liquid crystal display screen. Each quadrant is raster scanned individually. The circuit permits the LCD to be driven with low power and can operate from batteries. Independent input and output counters control the receipt and delivery of information.

BRIEF DESCRIPTION OF DRAWINGS

FIG. 7 illustrates an electrical schematic of an input circuit.

FIG. 8 illustrates an electrical schematic of a second input circuit.

DETAILED DESCRIPTION OF THE PRESENT INVENTION

Figure 1:
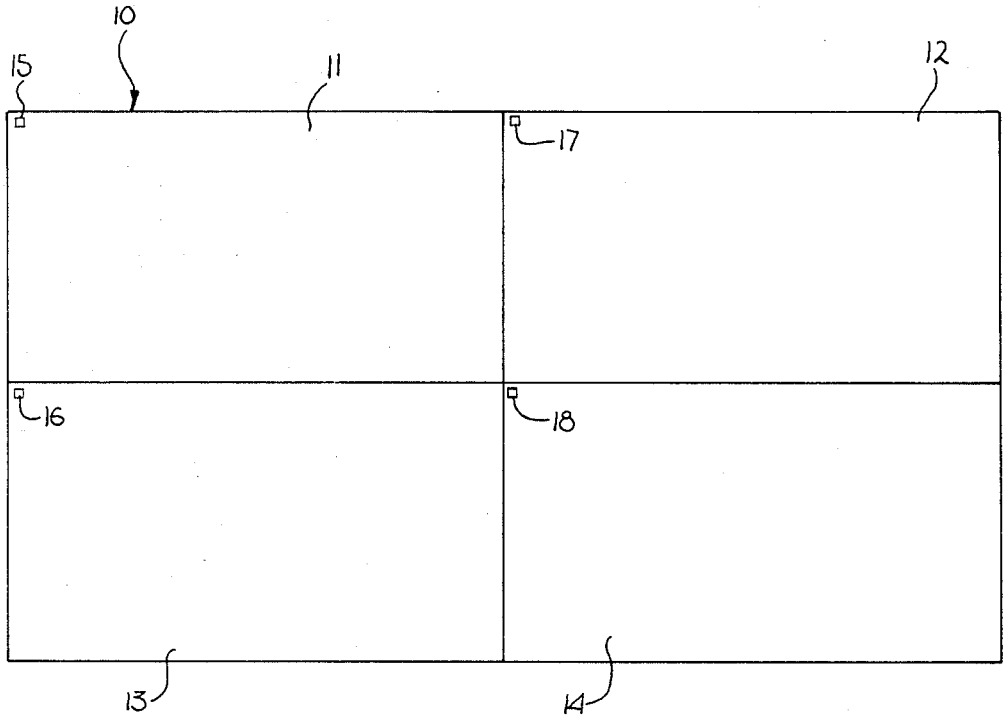
FIG. 1 illustrates one method of subdividing a display screen.

A driver circuit for use with computer displays is described. The circuit utilizes the video signal from a computer and is particularly useful with liquid crystal displays. In the following description, numerous specific details are set forth such as clock cycles, size of memory, etc., in order to provide a thorough understanding of the present invention. It will be obvious however, to one skilled in the art that the present invention may be practiced without these specific details. In other instances, well-known circuits and structures have not been shown in detail in order not to unnecessarily obscure the present invention.

The present invention utilizes a LCD display screen. In one embodiment the screen has 192 rows of lines, each line containing 560 pixels. This configuration permits the display of as much information as a standard computer CRT display. The number of pixels available is also sufficient to provide acceptable clarity and definition of the information displayed.

The information provided by the computer is in serial form. A continuous stream of data is fed to the display. In order to apply the information to LCD, it must be multiplexed. However, present day electronics limit multiplexing to a 100 to 1 line ratio. Since the video source is supplying 192 lines of data, the driver circuit must somehow divide the data. This is done in the present invention by electronically dividing the screen in two. Thus only 96 to 1 multiplexing is required, within the scope of present circuitry. The present invention then further sub-divides the screen into 4 quadrants. Next the serial information from the data source is divided into four data lines corresponding to each quadrant. Each quadrant is then scanned individually with information from its own data line.

One method of dividing the screen is shown in FIG. 1. The screen 10 has been subdivided into an upper left quadrant 11, an upper right quadrant 12, and a lower left and right quadrant 13 and 14 respectively. The subdivision is done electronically and not physically, minimizing any "border" effect between the quadrants. There are no visible lines of demarcation between the quadrants when the screen is in use. Each quadrant is supplied with information from its own data line and is raster scanned in the same manner as the full screen. The first pixel which appears in each scan, represented by pixel 15, 16, 17, and 18, appears at substantially the same time in each quadrant. The present invention takes the single display of the CRT display and segments it such that the segments are displayed substantially at the same time. In analogy it is equivalent to taking a frame of a CRT display and dividing it to provide a plurality of mini-frames for a liquid crystal display with each min-frame being shown substantially simultaneously.

Figure 2:
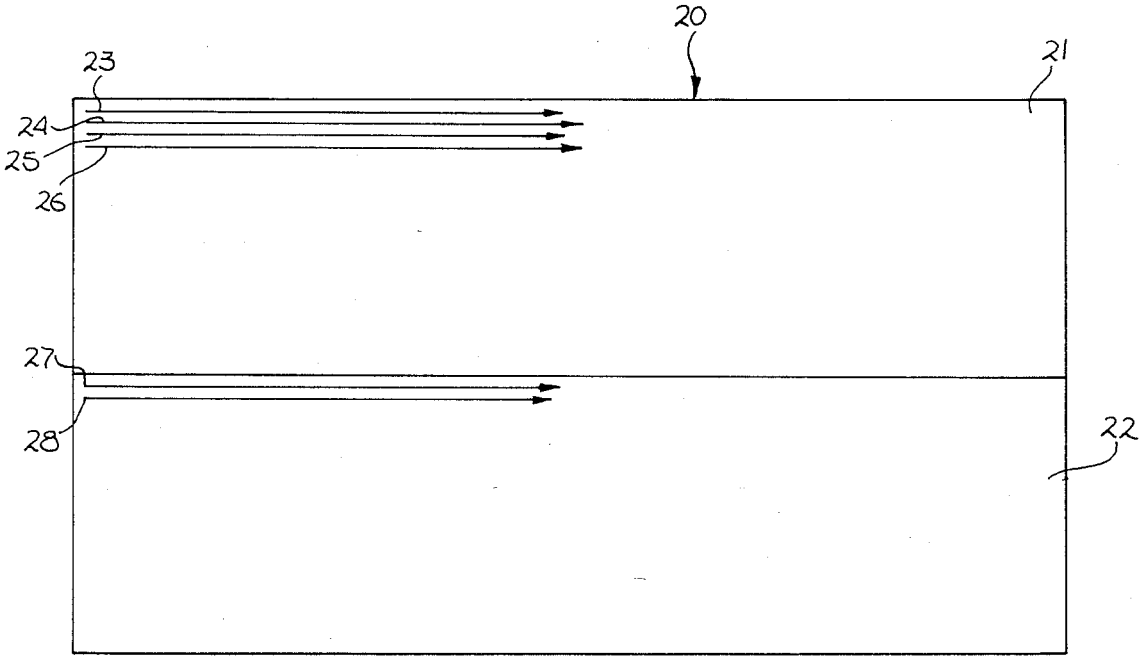
FIG. 2 illustrates an alternate method of subdividing a display screen.

A second method of dividing the screen is shown in FIG. 2. In this embodiment, the screen 20 is first divided into a top half 21 and a bottom half 22. All odd numbered rows, such as rows 23 and 25 of the top half 21 define one quadrant, while all even numbered rows of the top half 21, such as rows 24 and 26 define a second quadrant. The division is the same in the bottom half 22.

The data generated by the computer or other data source is a single stream of data. The data is buffered in the screen driver circuit before being released to the screen. In utilizing the present invention the data could be separated into four quadrants as it enters the buffer, as it leaves the buffer, or in some combination of the two. The preferred embodiment of the present invention separates the data as it enters the buffer.

OVERVIEW OF THE PRESENT INVENTION

Figure 6:
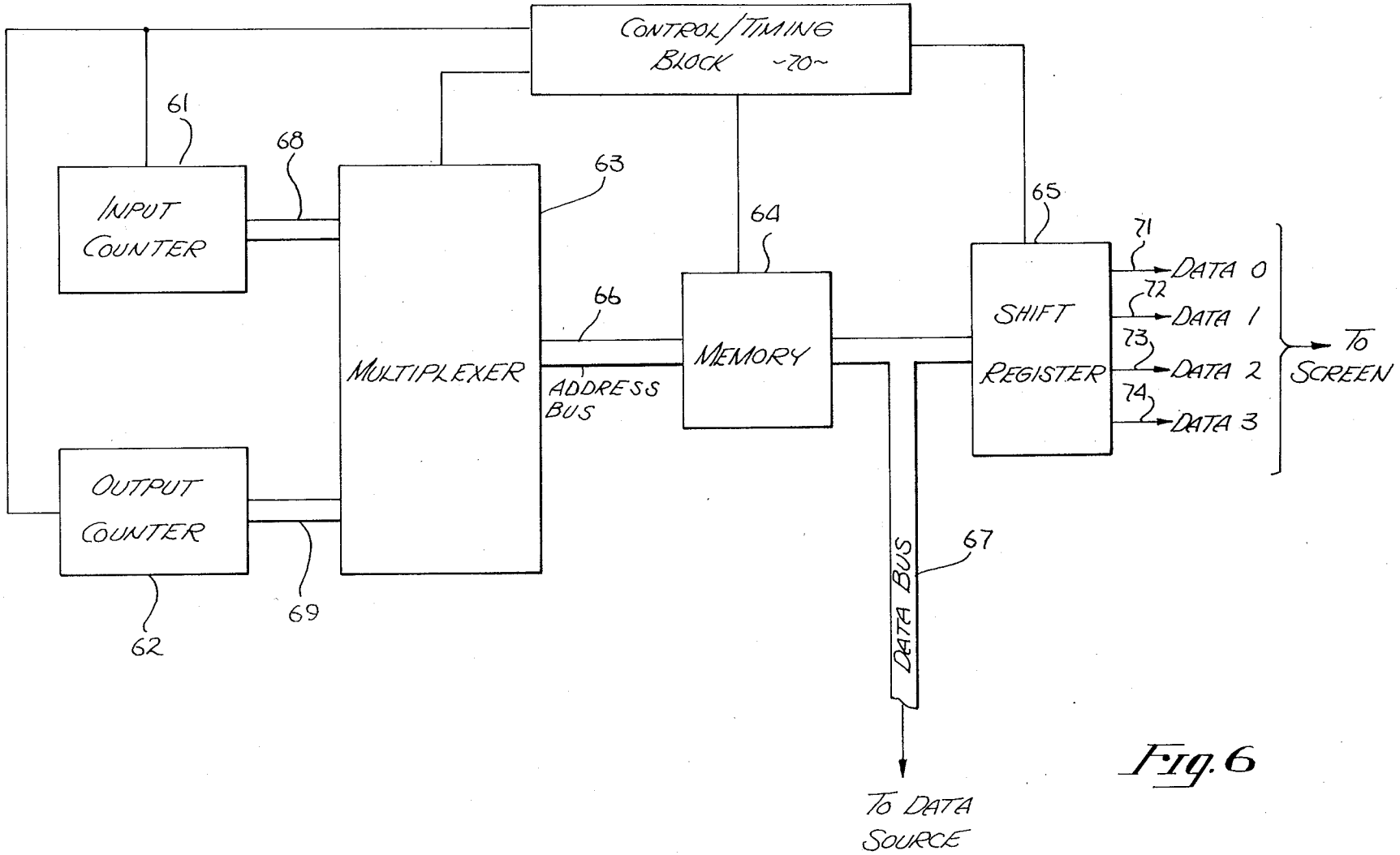
FIG. 6 illustrates a block diagram of the preferred embodiment of the present invention.

A block diagram of the preferred embodiment of the present invention is shown in FIG. 6. Two counters, input counter 61 (shown in detail in FIG. 5) and output counter 62 (shown in detail in FIG. 4) are coupled through a multiplexer 63 to a memory 64 (each shown in detail in FIG. 3*a*). The counters timeshare on the memory and operate independently of one another. Each has a frame rate of approximately 60 Hz in the preferred embodiment. Address information enters on the address bus 66 which is coupled to the multiplexor 63 and the memory 64. Data enters on data bus 67, coupled to the memory 64 and shift register 65. Acting through the multiplexer 63, the input counter 61 causes the address information and data to be placed in the memory 64 in locations corresponding to the four (4) quadrants of the display screen.

Acting through the multiplexer 63, the output counter 62 causes the memory 64 to release the data and send it to the shift register 65. The shift register 65 buffer the data for each quadrant one byte at a time. Data lines 71 through 74, one for each quadrant, present data to the proper screen locations. The clocking and control unit 70, coupled to each block, synchronizes the circuit and controls read/write operations.

DATA INPUT

In the present embodiment, information from the data source (computer) is presented to the circuit in serial form with a separate bit clock, with vertical and horizontal sync being on the same line. For example, the bit clock in the preferred embodiment is 14 Megahertz. The output of the data source, SEROUT in FIG. 7, enters a series to parallel register 75 and is converted to 8 parallel bits (1 byte). This information is then latched in register 76. Register 76 is coupled to data bus 36. In this manner, the driver circuit handles the video output from the computer one byte at a time.

In the computer utilized in the preferred embodiment, the video signal can be provided to the CRT in a 40 or 80 column format. In order to synchronize with the data provided, the LCD driver circuit must be told which mode is being used. This 40/80 column signal is shown as the LDPS input of the circuit in FIG. 8. The circuit is used to determine if this signifies 40 or 80 column mode. The LDPS signal is an input to the counter 77 along with the 14 MHz clocking signal from the data source. The output of this counter is inverted and coupled to the P terminal of flip flop 78. The output of this flip flop is coupled to the input of flip flop 79 whose two outputs are 40 Col and 80 Col.

HWNDW is a signal from the data source and is a composite horizontal and vertical synchronization signal. LC 60 is a master clock signal from the data source and is the clocking input of counter 69. HWNDW is the clear input signal of the counter 69, setting the output low regardless of other signals. The output of counter 69 travels on line 19 and passes through an inverter. The inverted signal, now on line 103, is VSync 40, the timing signal which controls the vertical synchronization of the data input through the input counter (shown in FIG. 5). VSync 40 is also coupled to the enabling inputs (Pins 7 and 10) of counter 69.

Figure 5:
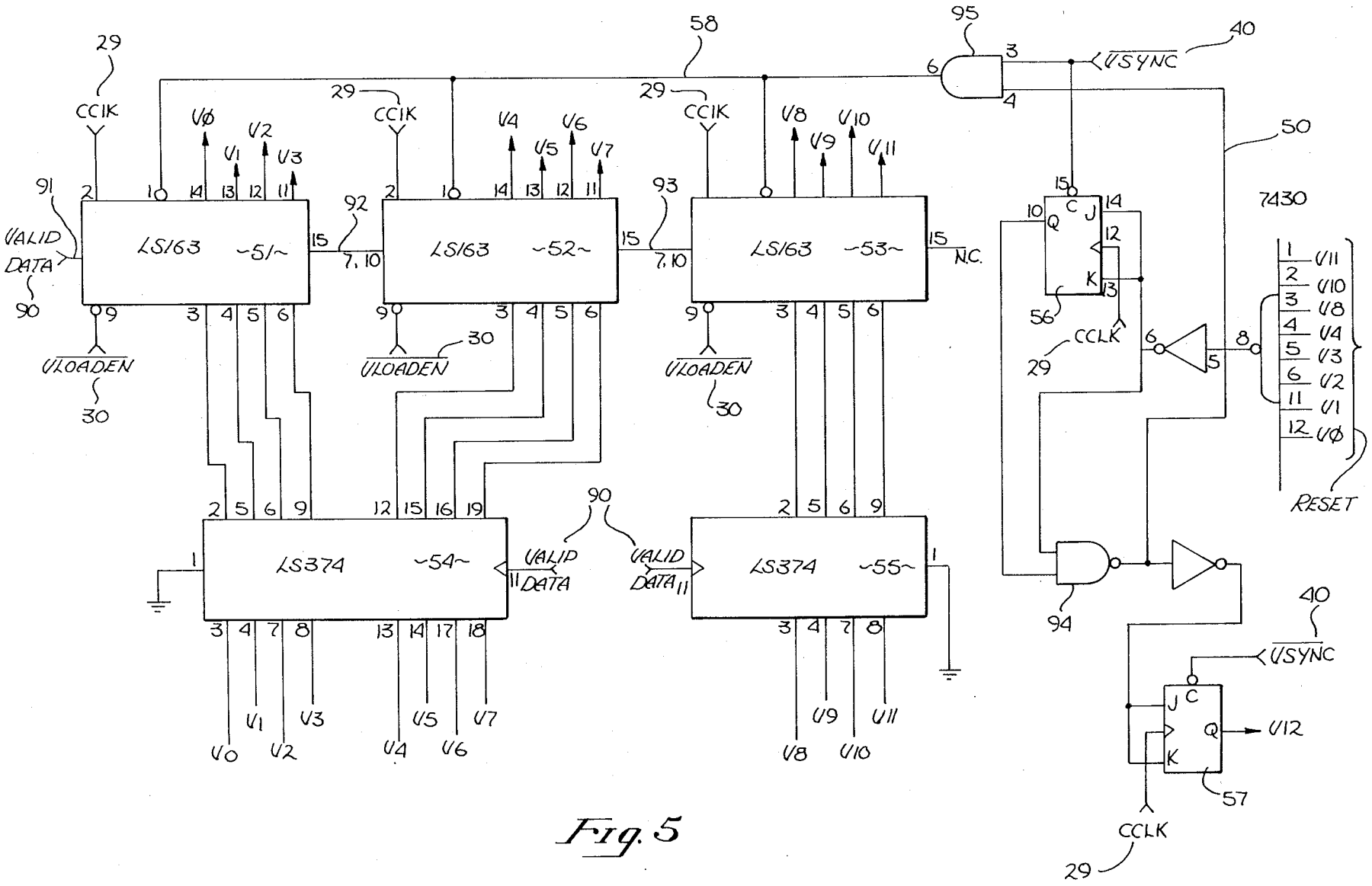
FIG. 5 illustrates an electrical schematic of a portion of the input counter.

HWNDW is also used to generate valid data signal 90, which instructs the input counter of FIG. 5 when to begin counting. HWNDW is the input into flip flop 110 which is connected to flip flop 111 in shift register fashion. The output of 110 is combined with output 111 as the inputs of data selector 80, with 40 Col being the selector signal. The output of this selector 80 is fed through flip flop 68 to generate the valid data signal 90.

CONTROL SIGNALS

Figure 10:
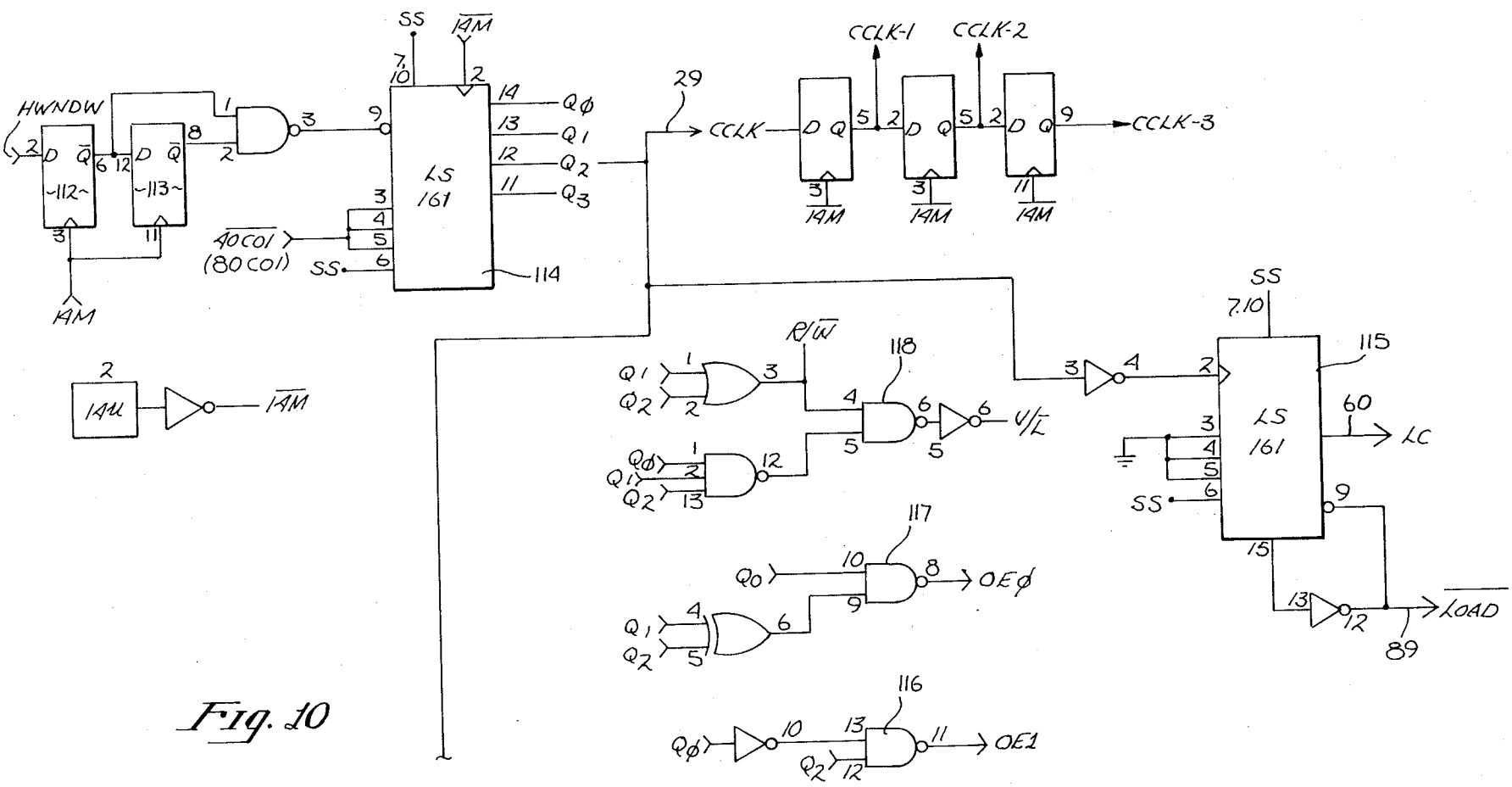
FIG. 10 illustrates an electrical schematic of a control circuit.

The HWNDW signal from the data source is also an input in the control circuit of FIG. 10. This signal is the input of flip flop 112 which is coupled to flip flop 113 as a shift register. The outputs of each flip flops are inputs of a NAND gate whose output provides the load input signal of counter 114. The inputs of counter 114 are the 80 Col signal from FIG. 8 and Signal SS. SS is a signal having a constant high value. The outputs of counter 114 are signals $Q_0$–$Q_3$. Output $Q_2$ is CCLK 29 and is passed through 3 flip flops whose respective outputs are CCLK1, CCLK2 and CCLK3. These three signals control the operation of the 4 parallel to serial registers of FIG. 3*b* which in turn provide data to the four quadrants of the display. CCLK is a character clocking signal used as the timing signal for portions of the input counter and output counter. CCLK is also inverted and input into counter 115 whose output is LC 60, a master clock signal, and whose carry output is inverted to generate $\overline{\text{LOAD}}$ 89, a signal used to enable the parallel to serial registers 41–44 of FIG. 3*b*.

$Q_2$, along with the inverted signal of $Q_o$, are inputs of NAND gate 116. The output of this gate is OE1, an output enabling signal for RAM 38 of FIG. 3*a*.

The NOR gate output of $Q_1$ and $Q_2$ is an input to NAND gate 117, along with $Q_o$. Gate 117's output of OEO, the output enabling signal for RAM 39 of FIG. 3*a*.

Figure 3A:
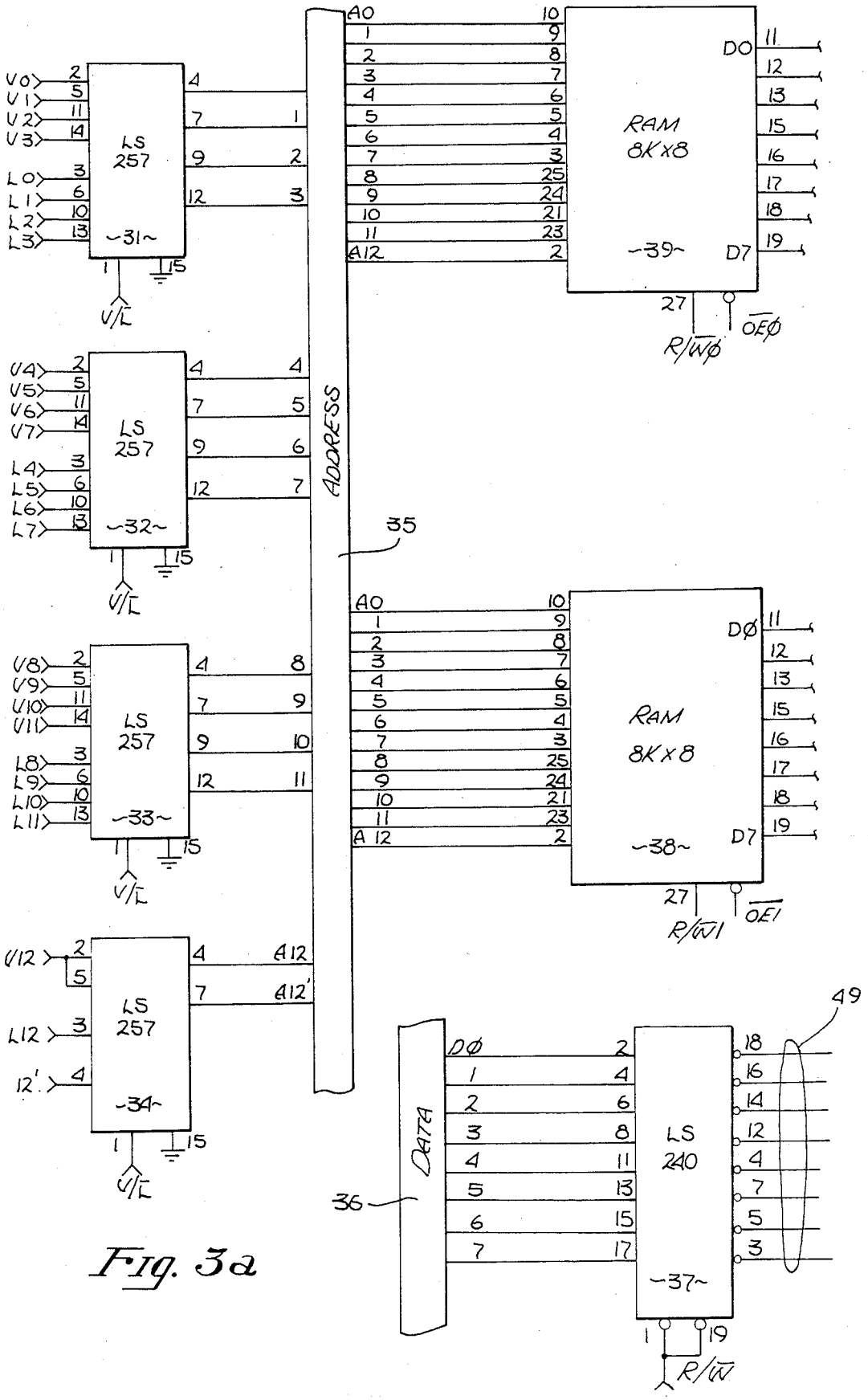
FIGS. 3*a* and 3*b* together, is an electrical schematic illustrating the data input, storage and output controls of the present invention.

The OR gate output of $Q_1$ and $Q_2$ is $R/\overline{W}$, a read/-write signal which activates register 37 of FIG. 3*a*. This signal is an input, along with the NAND gate output of $Q_oQ_1$ and $Q_2$, of NAND gate 118. The inverted output of this gate 188 is $V/\overline{L}$,. $V/\overline{L}$ is the selector input of multiplexers 31–34 of FIG. 3*a* and determines if information from the input or output counters is provided to the memory of the driver circuit.

Figure 9:
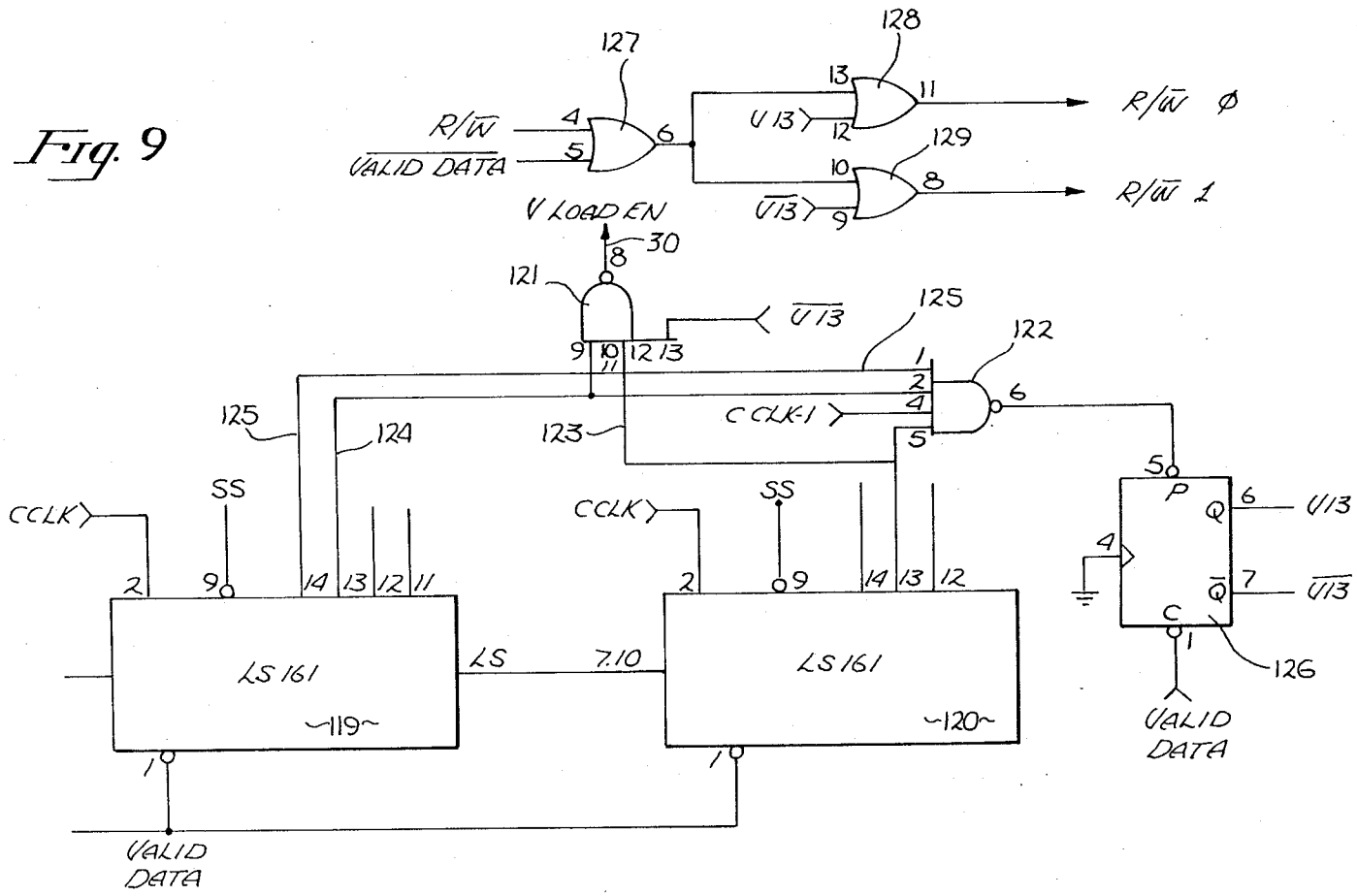
FIG. 9 illustrates an electrical schematic of a portion of the input counter.

Referring now to FIG. 9, a method for choosing between RAMS 38 and 39 of FIG. 3a is shown. Two counters 119 and 120 are connected in cascade fashion. An output 124 of counter 119 and the output 123 of counter 120 are passed through NAND gate 121 whose output, VLOADEN 30, controls the input counters 51–53 of FIG. 5. Outputs 124 and 125 of Counter 119, with output 123 of counter 120 and CCLK 1 signal from FIG. 10, are inputs of NAND gate 122. The output of this gate is the P input of flip flop 126. The outputs of flip flop 126 are V13 and V13'. V13 is an input of OR gate 128 and V13' is an input of OR gate 129. The other input of each gate is generated by combining R/$\overline{W}$ from FIG. 10 and valid data 90 from FIG. 8 through OR gate 127. The output of gate 128 is R/$\overline{W}$O, the read/write signal of RAM 39, and the output of gate 129 is R/$\overline{W}$ 1, and read/write signal for RAM 38 of FIG. 3. When R/WO is high, R/$\overline{W}$ 1 is low and vice-versa. The switch occurs each 35 counts.

INPUT COUNTER

A schematic drawing of the input counter is illustrated in FIG. 5. The purpose of the input counter is to control the timing of the introduction of data to the circuit memory from the computer source.

Counters 51, 52, and 53 are each 4 bit binary synchronous counters. The count enables inputs of each counter must be in the high state in order for the counters to count. The valid data signal 90 generated by the control circuit of FIG. 8, enters chip 51 on line 91, which is coupled to that chip's count enable inputs, causing them to read high when a valid data signal is received. The carry output of chip 51 is coupled via line 92 to the count enable inputs of chip 52. The carry output of chip 52 is in turn coupled by line 93 to the count enable inputs of chip 53. Thus, chip 52 is enabled when the carry output signal of chip 51 is high and chip 53 is enabled when the carry output of chip 52 is high.

CCLK 29 is the clock signal for each chip. This signal is generated by the control circuit of FIG. 10 and is a signal divided down from the data source. Counting or loading occurs on the positive transition of the CCLK pulse 29.

When the VLoaden signal 30 is low, the input of each counter is shifted to the outputs of each counter on the next positive clock transistion. The outputs of chip 51 are $V_0$–$V_3$, chip 52 are $V_4$–$V_7$ and chip 53 are $V_8$–$V_{11}$. The VLoaden signal 30 must meet the set up and hold-time requirements of the CCLK signal 29.

The outputs of the counters are coupled to the multiplexers of FIG. 3*a*, to the latches 54 and 55 of FIG. 5, and to the reset circuit of FIG. 5.

The latches 54 and 55 have as input the output of counters 51, 52 and 53. The latches are enabled by a low reading on the valid data signal 90. In operation, the counters 51–53 count from 0 to 34, repeat, from 35 to 69, repeat, from 70 to 104, repeat, and so on up to 3359. The use of the latches 54 and 55 makes this possible. As the count beings, the latches have stored 0. When 34 is rached, VLoaden 30 goes low, the contents of the latches, 0, is then placed at the counter outputs on the next positive clock cycle. The valid data signal 90 goes low, storing the previous output, 34, in the latches 54 and 55. When 34 is reached a second time counting continuous from 35 to 69. As the counter passes 35, valid data 90 goes low, storing that value, 35, in the latches. The count continues to 69 where VLoaden 30 goes low, causing 35, which is the contents of the latches, to be read at the outputs of the counters. When 69 is reached a second time, counting continues, with the latches storing 70 when it is passed. This process continues up to a value of 3359. At this point, the certain outputs of the counters coupled to the reset circuit all read high. Those outputs being $V_0$, $V_1$, $V_2$, $V_4$, $V_8$, $V_{10}$ and $V_{11}$. After passing through an inverter the signal reaches flip flip 56. When the flip flop is enabled by the CCLK signal 29, the signal is acted on by NAND gate 94, making it low. Through line 50 the signal reaches AND gate 95 along with VSync 40. VSync is a vertical synchronization signal. The output of Gate 95 is coupled to the clear input pins of each counter through line 58. When the clear input receives a low signal, the outputs of the counters are set low regardless of the enable inputs. This occurs at the next positive clock transition. In this manner, the entire counting cycle can be repeated. The purpose of the input counter is to place the serial output of the data source into the memory in a way which divides the screen in half. Looking at FIG. 1, the first line of quadrant 11 is placed in memory when the counter counts from 0 to 35 the first time. When the counter repeats that cycle, the first line of quadrant 12 enters the memory. The process continues for each line of the left half of the screen, quadrants 11 and 13, alternating with each line of the right half, quadrants 12 and 14.

The output of NAND gate 94 is also coupled, through an inverter, to flip flop 57. This part of the circuit is used to generate signal $V_{12}$ which is coupled to multiplexer 34 of FIG. 3*a* and is used to help determine which portion of memory the data will be entered into.

OUTPUT COUNTER

Figure 4:
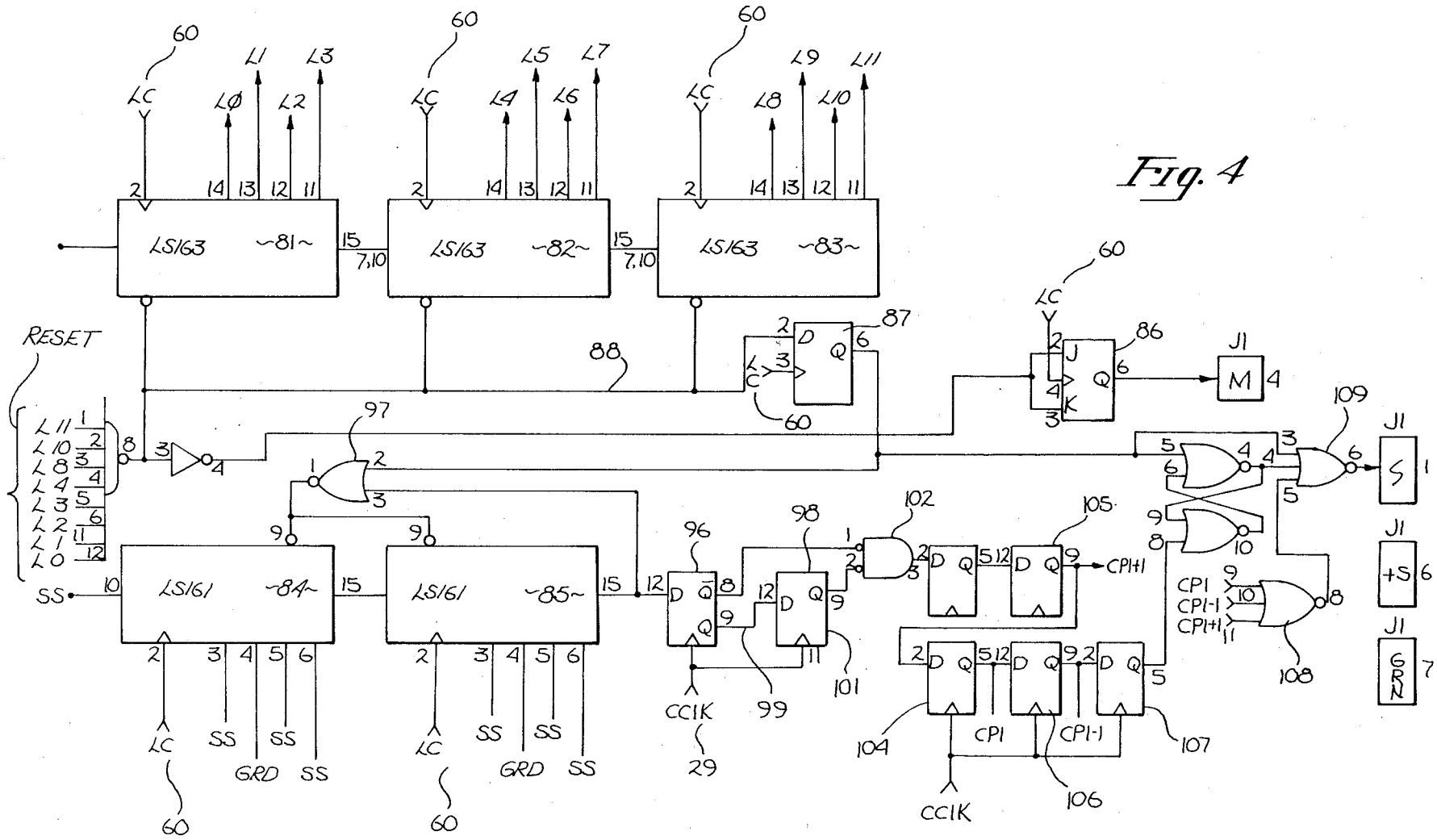
FIG. 4 illustrates an electrical schematic of the output counter.

The output counter is illustrated by the schematic drawing of FIG. 4. The output counter controls the output of data from the driver circuit memory to the display screen. The output counter timeshares the memory with the input counter. The two counters operate independently of each other.

Four bit binary synchronous counters 81, 82, and 83 are connected in cascade fashion. The carry output of counter 81 is coupled to the enable inputs of counter 82, while the carry output of counter 82 is coupled to the enable input of counter 83. The enable inputs of counter 81 are coupled to signal SS, which is always high. The enable inputs must be high in order for the counters to count, thus counter 81 is always enabled.

The counters count continuously from 0 to 3359, at which point they are reset to 0 and the cycle repeats. The output of counter 81, ($L_0$–$L_3$), of counter 82, ($L_4$–$L_7$), and of counter 83 ($L_8$–$L_{11}$) are coupled to the multiplexers of FIG. 3*a*. Selected outputs, namely $L_0$, $L_1$, $L_2$, $L_3$, $L_4$, $L_8$, $L_{10}$, and $L_{11}$ are also sampled by a reset circuit. When the counters reach the value of 3359, those selected outputs read high. This signal is inverted and travels on line 88 to the clear inputs of counters 81–83. A low signal at the clear input sets the output low regardless of the enable input values. Thus the counting cycle can begin anew.

The counting occurs on the positive transition of the clock pulse, L 60. The LC signal 60 is a master clock signal provided from the computer.

The counters 84 and 85 are coupled in cascade fashion. Each counter is also coupled to LC signal 60. The enable input of counter 84 is coupled to high signal SS. Three pins of the 4 bit input of each counter are coupled to signal SS with the remaining pin coupled to GRD. The carry output of counter 85 is coupled to NOR Gate 97. The other input of NOR Gate 97 is the output from flip flip 87, whose input is the signal on line 88. When either of these inputs is high, the output of the NOR gate 97 is low. This output is in turn coupled to the load pins 9 of the counters 84 and 85. When the signal here is low, upon the next positive clock transition the inputs of the counter (GRD and SS) are shifted to the corresponding outputs. This in turn causes the carry outputs to go low and the counting begins again.

The carry output of counter 85 is also coupled to flip flop 96. One output of the flip flop is coupled via line 98 to the NOR gate 102. The other output of flip flop 96 is coupled via line 97 to flip flop 101, whose output is coupled to NOR gate 102. When the carry output value of counter 85 is high, the output resulting at gate 120 is high as well.

The output of gate 102 is then passed through five D type flip flops connected as a shift register. Each flip flop utilizes CCLK 29 as the clocking line. The output of the 3rd flip flop 104 is CPI, a clocking signal which is coupled to the display and provides horizontal synchronization. The output of the 2nd flip flop 105 is CPI+1, and that of the 4th flip flop 106 is CPI−1. The output of the 5th flip flop 107 passes through a set-reset circuit and becomes one input to NOR gate 109. The output of gate 109 provides vertical synchronization for the display screen. Gate 109 has two other inputs. The first is provided by passing the signal on line 88 through flip flop 87, whose clock line is LC. The second comes from the NOR gate 108 output of CPI, CPI−1, and CPI+1.

At the end of each counting cycle, the output of the reset circuit is passed through an inverter and a flip flop 86 to generate a signal M. This signal is used to effect a logic level change after each scan of the LCD screen and alternates high and low. This signal guarantees that there will be no D.C. signal to the screen.

DATA STORAGE AND DISPLAY

Figure 3B:
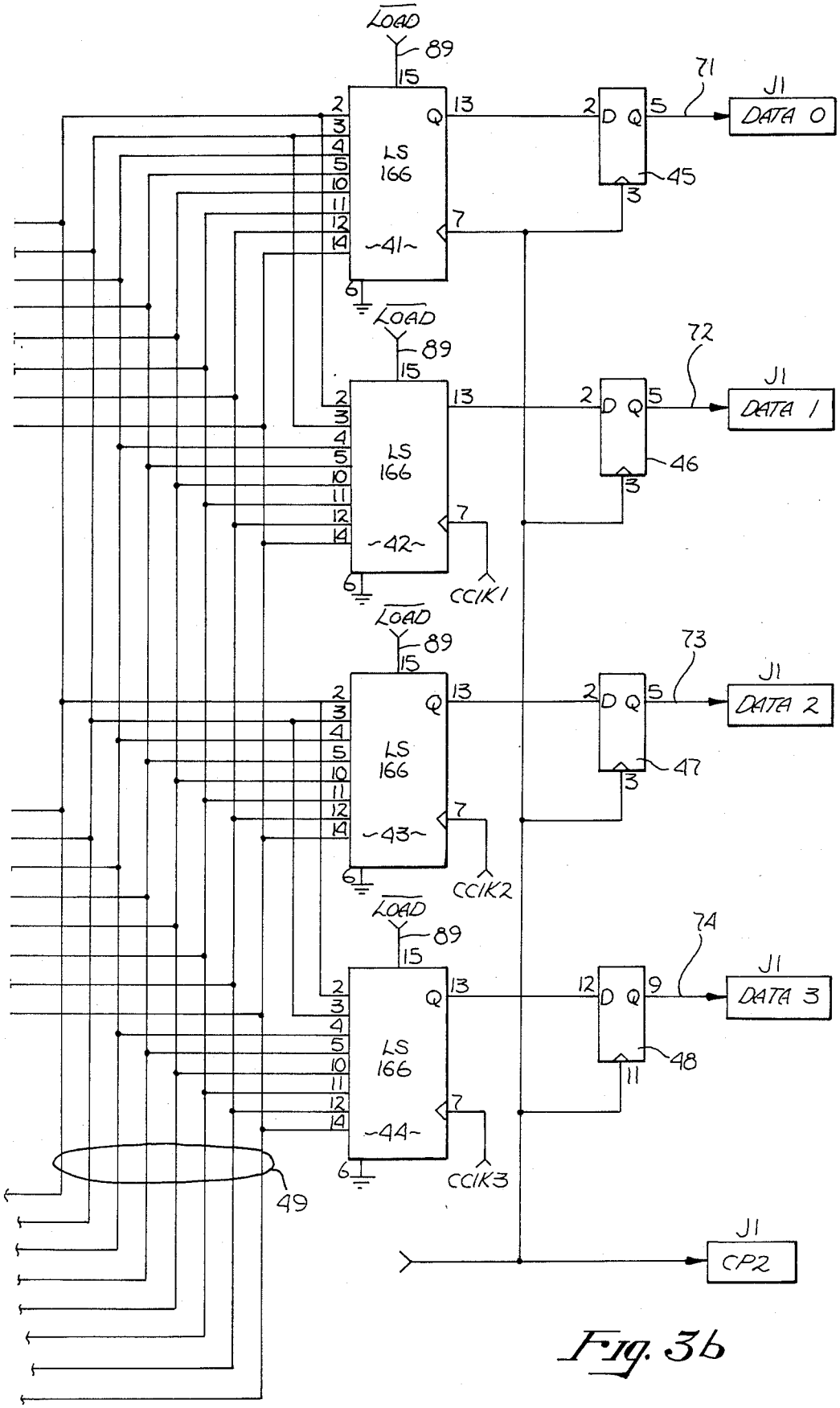

The means for storage of the data and its display on the screen is best described in conjunction with FIGS. 3*a* and 3*b*. In the preferred embodiment, 2 CMOS static RAMs 38 and 39 are used for memory. Each RAM has an 8K×8 capacity. When the display screen is divided as in FIG. 1, RAM 39 holds data corresponding to the left side of the screen, quadrants 11 and 13, and RAM 38 stores data for the right side of the screen, quadrants 12 and 14. If the screen configuration of FIG. 2 is used, RAM 39 stores all odd lines and RAM 38 all even lines.

Multiplexers 31 through 33 are two line to one line data selector multiplexers and are used to control the storage and retrieval of data by the RAMS 38 and 39. The input of these multiplexers consists of the output signals of the input and output counters. For example, multiplexer 31 has inputs $V_0$–$V_3$ from input counter 51 of FIG. 5, and input $L_0$–$L_3$ from output counter 81 of FIG. 4. The select input of each multiplexer has an input signal $V/\overline{L}$ from FIG. 10. This determines whether the input counter or output counter values are present on the output lines of the multiplexers.

A fourth multiplexer 34 has $V_{12}$ and $L_{12}$ and inputs and $V/\overline{L}$ as select input signals. The outputs of this multiplexer, A12, and A12', respresent the most significant bit of data entering the RAMS 38 and 39, respectively. Looking at RAM 38, if A12' on Pin 2 is high, data will be that corresponding to quadrant 12, if it is low, quadrant 14 is utilized.

A shift register 37 stores data from the data bus 36 a byte at a time. The enable inputs of register 37 are coupled to the $R/\overline{W}$ (read/write) signal generated by the control circuit of FIG. 10. When the read cycle is in effect, the register 37 is off. When write is effected, the register 37 gives data to the Bus 49.

The memories are also coupled to Bus 49, as are 4 parallel to serial registers 41–44. These take one byte of data and convert it to serial form. Registers 41–44 then provide this data to flip flops 45–48 respectively. The output of these flip flops is coupled to the screen and each output corresponds to one of the four quadrants of the screen.

In operation, when signals from the input counter are being processed by the multiplexers 31–34, addresses from the address bus are used to access RAMS 38 and 39. At this time data from the data bus 36 and register 37 is written into the RAMS at locations corresponding to its proper quadrant location. For example, data from quadrant 11 would be directed to RAM 39. The $R/\overline{W}O$ signal generated by the control circuit of FIG. 9 would have RAM 39 turned on, while the $R/\overline{W}$ 1 signal would turn RAM 38 off. Then, because for that data, A12 would be high, that data would be treated as quadrant 11 data by the RAM 39. For quadrant 13 data, A12 would be low.

When output counter data is received by the multiplexers 3134, register 37 is off and the data stored in the RAMs is read. The output enable signals OEO and OE1 are produced by the circuit of FIG. 10. Four read steps are done in a row, one by each of the parallel to serial registers 41–44. The data is then sent to the four quadrants of the screen.

TIMING SIGNAL

Figure 11A:
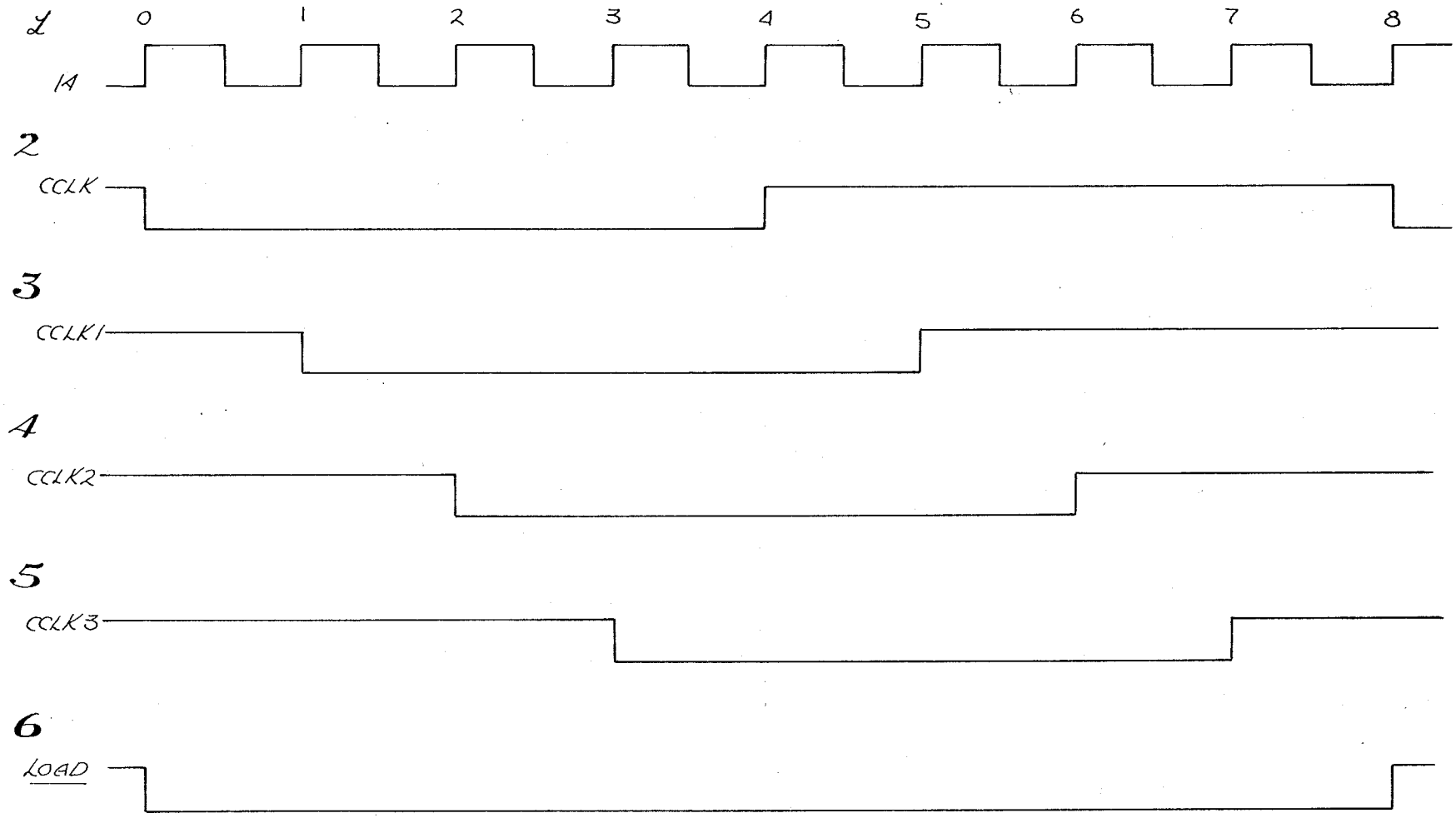
FIGS. 11*a* and 11*b* together illustrate certain timing signals of the present invention.
Figure 11B:
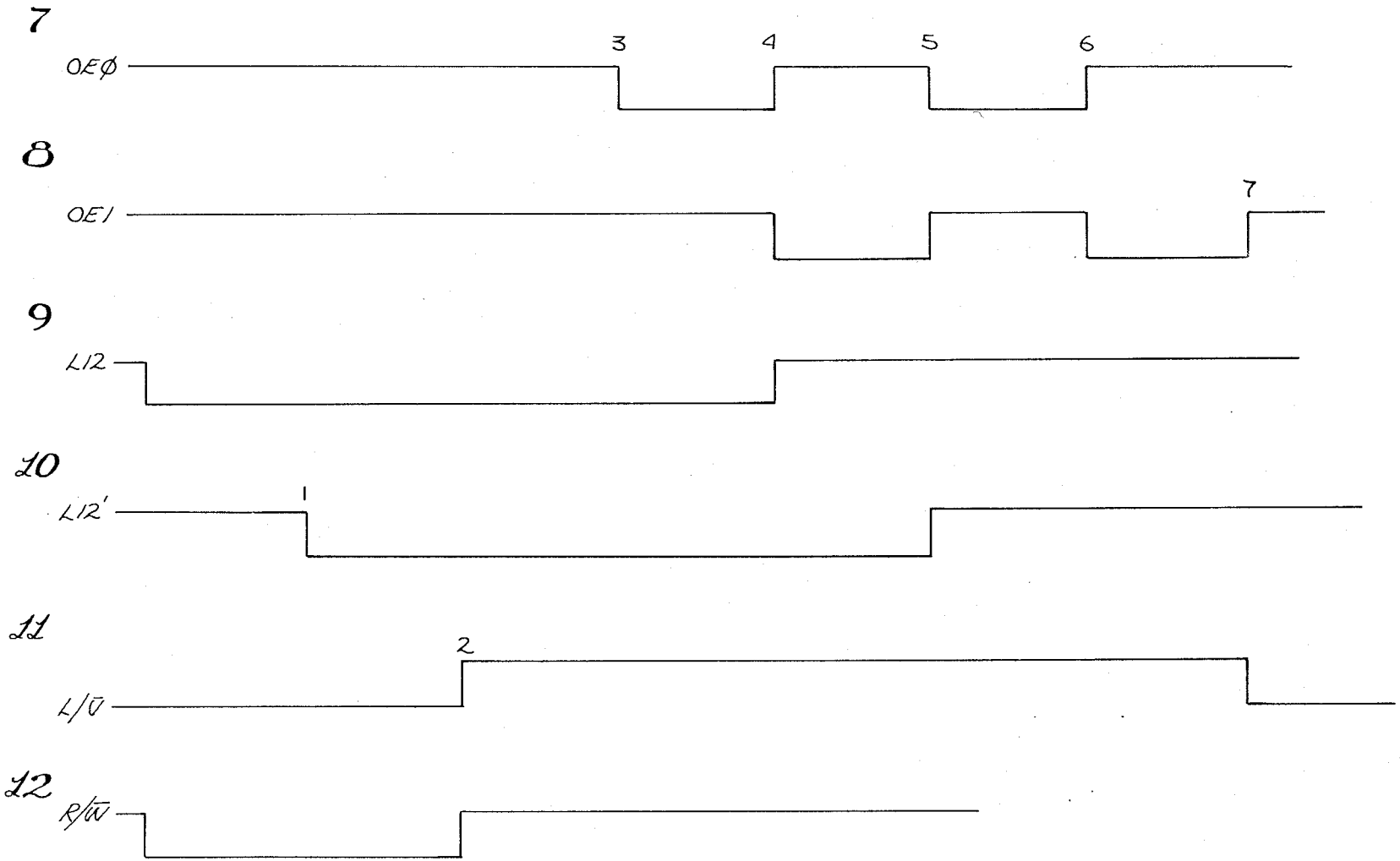

The timing signals described herein and their relationship to each other are illustrated in FIGS. 11*a* and 11*b*. A 14 MHz clocking signal is provided with the video data from the data source. This is the master clock signal and all other timing signals are divided down from it.

CCLK is a 1.78 MHz character clock signal which is the output clock to the display. Along with CCLK 1, CCLK 2 and CCLK 3, CCLK controls the four read operations from the circuit memory. Each signal begins one master clock pulse after the previous one.

Load 89 controls the parallel to serial registers 41–44 of FIG. 3. When on, data is fed through these registers from the memory to the display.

OEO and OE1 are output enable signals to RAMs 39 and 38 respectively and control the multiplexing of the data bus. OEO is high on even numbered positive master clock cycles, with OE1 high on odd numbered positive cycles.

L12 is the 12th address bit of RAM 39 and L12' is the 12th address bit of RAM 38. These are out of phase by one positive cycle of the master clock to achieve the read multiplexing. Both are 1.78 MHz signals.

$V/\overline{L}$ is a signal to determine whether the multiplexers 31–34 have input counter or output counter data as inputs and as a result, determines multiplexing of the address bus. $V/\overline{L}$ is a 1.78 MHz signal.

$R/\overline{W}$ is a 1.78 MHz signal which instructs the memory to read or write. A low signal is a write command.

Thus, a circuit has been described which enables the serial output of a data source designed for a CRT display to be utilized as the data source for a liquid crystal display.

I claim:

1. A circuit for accepting from a data source video information which is intended for a cathode-ray-tube (CRT) screen and providing video signals for display onto a liquid crystal display (LDC) screen comprising:

a data line coupled to said data source for transferring of said video information to said circuit;

a memory coupled to said data line for storing said video information;

addressing means coupled to said memory for addressing locations of said memory;

first counting means coupled to said addressing means for providing address signals to input said video information into said memory;

second counting means, operating independent of said first counting means, coupled to said addressing means for providing address signals to output said video information from said memory;

output means coupled to said memory and said LCD screen for receiving an output of said memory and generating said video signals to said LCD screen;

controlling means coupled to said memory, output means, address means, first and second counting means for generating control and timing signals which provide for said video information to be divided into a plurality of segments as it is loaded into said memory and outputting said segments, such that said video information ,when input into said memory, is subsequently generated as a plurality of segments;

said output means receiving said plurality of segments for said video information and providing said segments for substantially simultaneous presentation on said LCD screen;

whereby said video information intended for said CRT screen is displayed on said LCD screen.

2. The circuit as defined by claim 2 wherein said memory includes a plurality of random access memories (RAMs).

3. The circuit as defined by claim 2 wherein said addressing means includes a multiplexer to switch between outputs of first and second counting means.

4. The circuit as defined by claim 3 wherein said output means includes a plurality of shift registers for converting said output of said memory to a plurality of segmented serial video signals.

5. The circuit as defined by claim 4 wherein said first counting means includes a plurality of binary counters.

6. The circuit as defined by claim 5 wherein said second counting means includes a plurality of binary counters.

7. A circuit for accepting from a data source serial video information which is intended for a cathode-ray-tube (CRT) screen and providing video signals for display onto a liquid crystal display (LCD) screen comprising:

input means coupled to said data course for receiving a stream of serial video information from said data source and converting said serial video information to parallel data;

a memory for storing said video information, said memory coupled to said input means;

output means coupled to said memory and said LCD screen;

addressing means coupled to said memory for addressing locations of said memory;

a first counter coupled to said addressing means for providing address signals to input said parallel data into said memory;

a second counter, operating independent of said first counter, coupled to said addressing means for providing address signals to output said video information from said memory;

controlling means coupled to said memory, input means, output means, addressing means, first and second counters for generating control and timing signals which provide for said video information to be converted to parallel data and divided into a plurality of segments as it is loaded into said memory by locations addressed by said first counter;

said control means subsequently accessing said memory by locations addressed by said second counter, wherein said memory outputs said plurality of segments to said output means;

said output means receiving said plurality of segments for said video information and providing said segments for substantially simultaneous presentation of said LCD screen;

whereby said video information intended for said CRT screen is displayed on said LCD screen.

8. The circuit as defined by claim 7 wherein said addressing means includes a mutliplexer to switch between outputs of first and second counters.

9. The circuit as defined by claim 8 wherein said memory includes two Random Access Memories (RAMs), the first of said RAMS storing information corresponding to a first segment and the second of said RAMs storing information corresponding to a remaining segment.

10. The circuit as defined by claim 9 wherein said output means includes shift registers, each of said registers coupled to receive a segmented output from said RAMs and converting each segment to a serial data stream for substantially simultaneously presentation of said segments comprising said video information to said LCD screen.

11. The circuit as defined by claim 10 wherein said first and second counters operate independently of each other and at approximately the same rate of speed.

12. The circuit as defined by claim 11 wherein said first counter includes a plurality of binary counters.

13. The circuit as defined by claim 12 wherein the second counter includes a plurality of binary counters.

14. The circuit as defined by claim 11 wherein said LCD screen is approximately rectangular and is electrically divided into four rectangular equal-sized quadrants corresponding to the upper left, upper right, lower left and lower right portions of said screen, such that each said segment corresponds to one of said quadrants.

15. The circuit as defined by claim 11 wherein said LCD screen is approximately rectangular and is electrically divided into a top half and a bottom half, such that each said segment corresponds to one of said halves.

* * * * *